US005628173A

United States Patent [19]

Landmesser et al.

[11] Patent Number: 5,628,173

[45] Date of Patent: May 13, 1997

[54] METHOD AND APPARATUS FOR FEEDING SLIVER TO A SPINNING MACHINE WITHOUT SLIVER CANS AT SPINNING STATIONS

[75] Inventors: Paul Landmesser, Erkelenz, Germany; Dirk Koltze, Charlotte, N.C.; Dieter Jinkertz, Willich, Germany

[73] Assignee: W. Schlafhorst AG & Co., Moenchengladbach, Germany

[21] Appl. No.: 523,276

[22] Filed: Sep. 5, 1995

[30] Foreign Application Priority Data

Sep. 14, 1994 [DE] Germany ..... 44 32 634.3

[51] Int. Cl.[6] ..... D01H 9/10; D01H 9/14

[52] U.S. Cl. ..... 57/281; 19/159 A; 57/90; 57/268; 57/270

[58] Field of Search ..... 57/90, 281, 266, 57/268, 270; 19/159 A

[56] References Cited

U.S. PATENT DOCUMENTS

| | | | |
|---|---|---|---|
| Re. 31,839 | 2/1985 | Schippers et al. | 57/281 |
| 1,727,764 | 9/1929 | Gibbs . | |
| 3,246,371 | 4/1966 | Tooka | 19/159 A |
| 3,599,417 | 8/1971 | Zurhelde et al. | 57/281 |
| 4,817,737 | 4/1989 | Gualchierani | 57/281 |
| 4,821,504 | 4/1989 | Shinkai et al. | 57/266 |
| 5,138,828 | 8/1992 | Stahlecker | 57/281 |
| 5,222,856 | 6/1993 | Yamamoto et al. | 57/281 |
| 5,311,645 | 5/1994 | Schwalm et al. | 57/90 |
| 5,333,440 | 8/1994 | Tsuzuki | 57/90 |
| 5,390,484 | 2/1995 | Schwalm | 57/281 |
| 5,414,986 | 5/1995 | Landmesser | 19/159 A |

FOREIGN PATENT DOCUMENTS

| | | |
|---|---|---|
| 0340459A1 | 4/1989 | European Pat. Off. . |
| 2929391A1 | 2/1981 | Germany . |
| 3802414 | 8/1989 | Germany . |
| 4118957A1 | 12/1992 | Germany . |
| 4204044A1 | 2/1993 | Germany . |
| 4125383A1 | 2/1993 | Germany . |
| 4217981A1 | 12/1993 | Germany . |

*Primary Examiner*—William Stryjewski
*Attorney, Agent, or Firm*—Shefte, Pinckney & Sawyer

[57] ABSTRACT

Sliver is delivered from a drawing frame to an open-end spinning frame in sliver containing cans and, at a transfer location along the travel path of a servicing device for the spinning frame, sliver is removed from the cans in partial lots and transferred to a sliver transport location on the service device to be transported to a spinning station whose sliver supply has been exhausted, whereat the servicing device performs the transfer of the sliver lot to the spinning station as well as the introduction end the piecing-up of the sliver.

17 Claims, 5 Drawing Sheets

METHOD AND APPARATUS FOR FEEDING SLIVER TO A SPINNING MACHINE WITHOUT SLIVER CANS AT SPINNING STATIONS

FIELD OF THE INVENTION

The present invention relates to a method and apparatus for supplying the spinning stations of an open-end spinning frame with a sliver, which is placed into cans at a drawing frame and conveyed to the spinning frame in such cans, where it is spun into yarn.

BACKGROUND OF THE INVENTION

Generally, a sliver to be spun into yarn is delivered in cans to open-end spinning frames. The cans are deposited underneath the spinning stations and the sliver is introduced from the can to the spinning station. The cans as a rule are wide as two adjoining spinning stations, so that two adjoining spinning stations are supplied with sliver from two sliver cans resting one behind the other, thereby creating two rows of sliver cans along the length of the machine.

In spinning machines wherein the supply of sliver cans to and the changing of the sliver cans at the spinning stations is automated, the changing of an empty can in the second row (I.e. Closest to the spinning stations) requires a particular technical effort if the disposition of the sliver can in the first row in relation to the spinning station is to be preserved. An example of this type of automated machine is shown and described in German Patent Publication DE 41 25 383 A1.

A yarn break occurs when a sliver can runs out of sliver. A piecing carriage is then called to the spinning station to repair the yarn break. However, the yarn break cannot be fixed by repiecing the sliver because the sliver is missing. The piecing carriage therefore leaves the spinning station and signals a request for delivery of a full sliver can to that spinning station. The piecing carriage is returned to the spinning station only after the replacement sliver can has arrived in order to thread the sliver (if sliver threading is automated) and to perform the piecing process. The supply of the spinning stations with sliver in this way is time-consuming and reduces the effective use of each respective spinning station during sliver can changes.

SUMMARY OF THE INVENTION

It is according an object of the present invention to simplify the supply of sliver to the spinning stations of a spinning machine and to perform such operation with less expenditure of time.

This object is attained in accordance with the present invention by means of a method utilizing a spinning frame apparatus having a plurality of aligned spinning stations for spinning sliver into yarn and a servicing device movably disposed to travel in a path along the spinning stations for performing servicing operations at the spinning stations. According to the present method and apparatus, means are provided on the servicing device for receiving and transporting a quantity of sliver during traveling movement of the servicing device, a sliver transfer location is located along the travel path of the service device, and a sliver transfer device is provided at the transfer location for removing a partial lot of sliver from a sliver containing can at the transfer location and transferring the partial sliver lot to the sliver receiving and transporting means on the servicing device. A storage location is provided at each spinning station for containing sliver being supplied to the spinning station during spinning of yarn and means on the servicing device operates for transferring a partial lot of sliver from the sliver receiving and transporting means to a spinning station storage location. A manipulator on the servicing device then introduces an end of the partial lot of sliver from the spinning station storage location into the associated spinning station. Means are also provided for detecting the absence of a supply of sliver at the storage locations of the spinning stations.

Thus, the feeding of the sliver from cans situated at the spinning stations is no longer necessary in accordance with the present invention. Instead, the cans filled with sliver are transported to the transfer point at the open-end spinning frame located along the route already followed by the service devices which move along the spinning stations. The cans are therefore no longer brought from the drawing frame to the individual spinning stations but only to the transfer point, where the sliver is removed from the cans.

The service device can be connected with a separable piecing carriage. The piecing carriage with the coupled service device loaded with sliver travel together along the spinning stations. If sliver is missing at a spinning station, the service device deposits the sliver it received at the transfer point to a sliver storage location associated with the spinning station. With its manipulator, the piecing carriage places the leading end of the sliver into the spinning station and performs the piecing-up operation. When the service device no longer has sliver, it is uncoupled from the piecing carriage and travels back to the transfer point for taking up a new supply of sliver. The service device subsequently travels back in the direction toward the piecing carriage which in the meantime operates to fix any yarn breaks which are not caused by a lack of sliver. As soon as the service device has again been connected with the piecing carriage, both continue their travel together.

However, the piecing carriage itself can be appropriately equipped so as to also perform the operation of the service device. To speed up the overall sliver replacement process it is advantageous to first store the sliver supply at predetermined storage locations. In the case of sliver cans completely filled with sliver, the contents are separated and deposited in two partial storage lots. In the process, the respective starting end of each lot of sliver is grasped and deposited at a defined place and at a defined length at the respective storage location, so that it can be later located and grasped by a manipulator for automatic introduction of the sliver into the spinning stations. If the contents of a can are divided into several partial lots, the new start of a subsequent partial lot is grasped during the dividing process every time the sliver is cut, and is deposited at a defined place and at a defined length at a storage place at the transfer point.

In accordance with a further development of the present invention, the traveling service device is in the form of a piecing carriage and is equipped for transporting and transferring the sliver to the spinning stations. Every time the piecing carriage arrives at the transfer point and no longer has sliver aboard, a partial sliver lot is transferred from the storage location of the transfer point to the service device. The leading end of the sliver is grasped and held by the manipulator of the piecing carriage at the defined location for introducing the sliver. If the piecing carriage is equipped to transport two partial sliver lots, the sliver start of the first partial lot to be taken up is first held at a defined place on the piecing carriage by means of the manipulator. Then the second partial lot is transferred and the leading end of sliver of this partial lot is grasped by the manipulator prior to the transfer and is held during the transport to a spinning station where sliver is lacking. Thus, following the transfer of the partial sliver lot to the piecing carriage, the second lot of sliver then can be introduced directly into the spinning station. Following the introduction of the sliver, the piecing process is performed by the piecing carriage. Transporting of the sliver to the spinning stations, introduction of the start of the sliver into the spinning station and piecing are performed by the same device.

In one embodiment of the present invention, the transfer point for the sliver from the cans to the piecing carriage is disposed at the reversing point or points in the traveling path of the piecing carriage, which as a rule are located at the head ends of a spinning frame. For reasons of space the installation of a transfer point at one head end of a spinning frame is advantageous. It is then only necessary to extend the path of the piecing carriage as far as this transfer point. If a spinning frame has a piecing carriage for the spinning stations at both sides of a two-sided spinning machine, a transfer point can be provided for each piecing carriage at a reversing point of its path.

The supply of the spinning stations with sliver by the piecing carriage and the deposition of the sliver at the spinning stations without utilizing sliver cans provides considerable advantages. First, none of the cans normally resting at the spinning stations are needed. Cans are only required for transport from the drawing frame to the individual spinning machines. In turn, the vehicles utilized only for can transport thus require considerably less elaborate control devices in that all they need to do is travel to the respective transfer points at the head ends of the spinning frames for depositing the full cans thereat and to pick up the empty cans therefrom. Transporting the cans to the textile machines by means of conveyor belts or roller conveyors or even manually is conceivable.

In accordance with the method of the present invention, the piecing carriage patrols along the spinning stations of the open-end spinning frame. If a spinning station reports a yarn breakage, the piecing carriage is positioned at this spinning station to check first whether sliver is still drawn into the condenser at the spinning station. If this is the case, a piecing operation is performed. However, if sliver is lacking, the piecing carriage deposits the partial sliver lot it has transported into the sliver storage location, typically a compartment underneath the spinning station, for example. The manipulator which already has the leading end of the sliver ready, pivots to the condenser and opens it for introducing the sliver into the spinning station. The spinning station is subsequently started and the piecing operation is performed by the piecing carriage. After the piecing operation has been successfully completed, the piecing carriage travels along the spinning stations toward the reversing point. If the piecing carriage no longer contains sliver, only yarn breaks because of yarn defects are corrected during the travel to the reversing point, while yarn breaks because of lack of sliver are ignored during this trip. However, if the piecing carriage carries two partial sliver lots, this second partial lot will be delivered to a spinning station which requires sliver. The piecing carriage then receives fresh partial sliver lots at the reversing point (or at such other sliver transfer points along the carriage travel path).

Since it takes considerably longer to use up an amount of sliver than for the piecing carriage to complete a patrolling travel along the machine between two reversing points, it is generally unlikely that the piecing carriage, even when transporting only one partial lot, will be called upon to repair two successive yarn breaks occurring because of a lack of sliver. In other words, the time normally occurring between two yarn breaks caused by lack of sliver is sufficient for the piecing carriage to be provided with fresh sliver at a transfer point.

The advantages of the invention reside in that in case of a lack of sliver the piecing carriage can directly satisfy the lack of a sliver supply and can also perform the piecing operation immediately. As a result, the efficiency of a spinning station is considerably increased, since the downtime normally occurring during conveyance of a sliver can by means of a separate process step is completely omitted. The additional load on the piecing carriage because of transporting the sliver is not significant, because the operation of supplying sliver to the carriage can always take place at a transfer point when the carriage has reached its reversing point. For example, forty piecing operations because of a yarn defect may be performed on average by a piecing carriage in an hour, while only approximately four operations may be needed for supplying sliver to a spinning station.

A further advantage resides in that there is no stock of cans required in the aisles between the spinning frames. As a result, it is possible to save space and to bring the frames closer to each other. Furthermore, communication between the spinning frames and the drawing frame is simplified. There is no individual demand for a full can made by a single spinning frame. Thus, in spinning frames with approximately 240 spinning stations, 240 sensors which monitor the positioning of a can transport vehicle and the can changing operation can be omitted. A batch change can be initiated in a controlled manner by switching off individual spinning stations, since they are no longer serviced by the piecing carriage.

In the course of a batch change, it is possible to manually supply the spinning stations of a spinning frame by the insertion of partial sliver lots of different sizes. Following the starting of the spinning frame, the piecing carriage begins operating without additional data traffic and the frame quickly reaches its static build-up state.

Existing frames can be easily retrofitted in accordance with the present invention because the only requirement is to provide compartments for the partial sliver lots at the places where the sliver cans normally rest. These compartments can be simple boxes, which are placed above each other in case of adjacent spinning stations. The compartments of an entire section can be structurally combined into one unit. Such a unit can be pulled out as a whole from underneath a spinning section, for example for cleaning. These compartments can be provided with rollers for this purpose. If need be, it is also possible by the removal of the compartments to again provide sliver supply to the spinning stations by means of sliver cans. It is necessary to retrofit the piecing carriage with a suitable arrangement for receiving partial sliver lots and it must additionally be provided with a manipulator for introducing the sliver. The transfer points can be installed at the reversing points of the piecing carriage. The reception stations for full cans, the devices for removal of the sliver from the cans, the storage places for depositing partial sliver lots and means for depositing the respective leading end of sliver of a defined length at a defined place are located thereat.

If the spinning stations are provided with devices which permit monitoring of the amounts of spun sliver and the amounts of yarn made therefrom, it is possible to minimize the remaining amount of sliver during a batch change by means of an exactly calculated amount of sliver. To be able to deliver such an exactly defined amount of sliver, the gripper for removing the sliver from the sliver cans may be provided with a weighing device. A predetermined amount of sliver can be removed by an appropriately controlled insertion of the gripper. This amount can be weighed during removal and a conclusion as to the yarn amount to be spun drawn from the determined weight.

The instant invention has the advantage over the method known from German Patent Publication DE 42 17 981 A1 that the sliver does not need to be conveyed by means of a separate vehicle to a spinning station where there is a lack of sliver. Thus, the entire outlay of control devices for positioning this vehicle in front of a spinning station can be omitted.

The invention also has an advantage over European Patent Application 0 340 459, from which it is known to transport large sliver cans along a spinning frame and to transfer sliver from such a sliver can into empty cans found a spinning stations. Such a process blocks a spinning station for a disproportionately long time, because it is required to first await the transfer of the sliver from a large can into a can at the spinning station. The piecing process can only be performed after the service device once the large sliver can has departed the spinning station. Furthermore, the sliver is still deposited in cans below the spinning stations as in connection with conventional spinning frames.

DETAILED DESCRIPTION OF THE PREFERRED EMBODIMENTS

Figure 1:
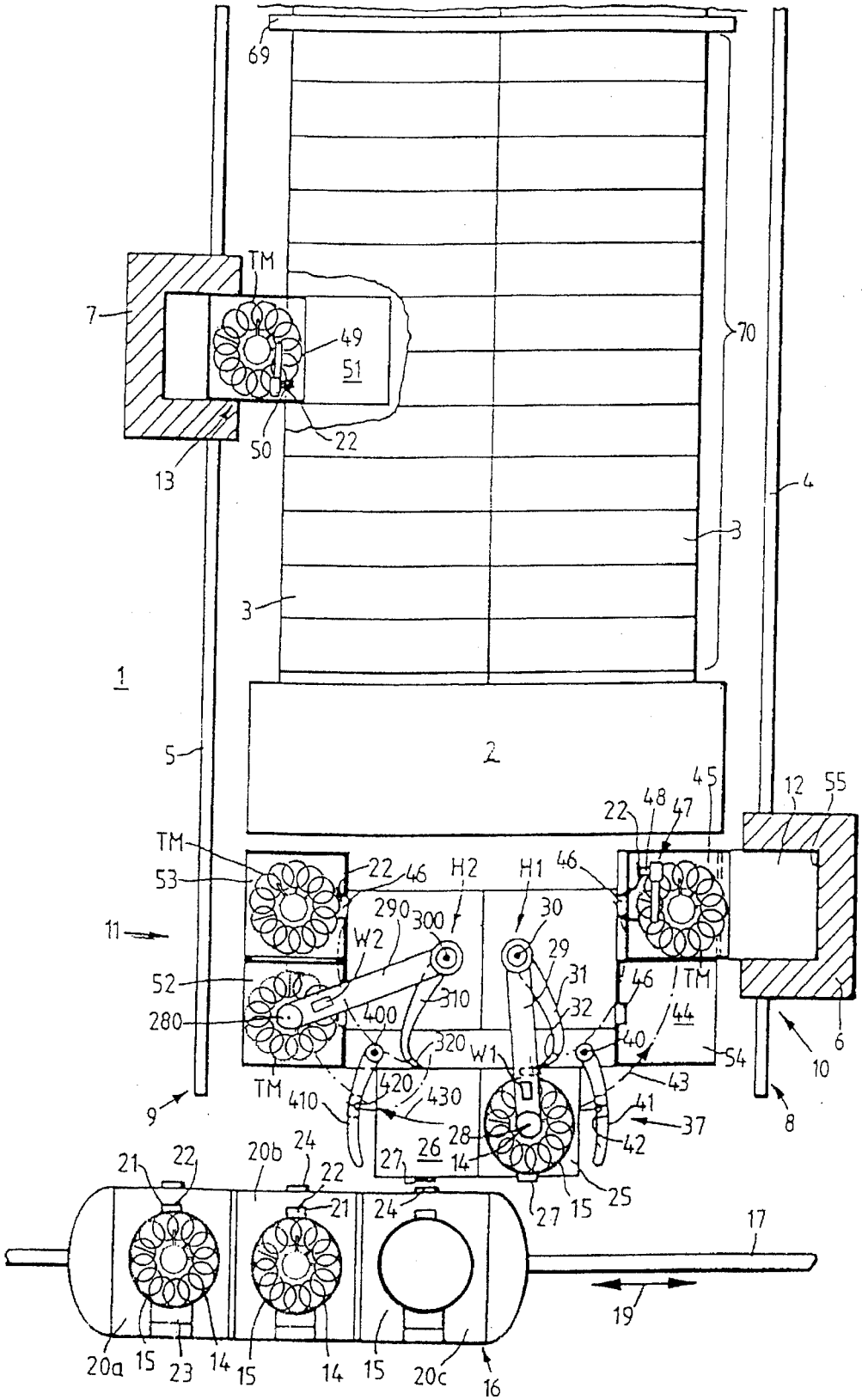
FIG. 1 is a top plan view of a spinning frame wherein, according to the present invention, a sliver transfer arrangement is installed at the reversing points of the service devices at the respective head ends of the spinning frame (only one head end being shown)

A top view of the head end 2 of an open-end spinning frame 1 having a number of aligned spinning stations 3 along opposite lengthwise sides of the spinning frame is represented in FIG. 1. Since the construction and operation of such spinning machines are well known, only the characteristics of the machine which aid in understanding the present invention have been represented and will be described, Respective rails 4 and 5 extends along the spinning stations 3 on both sides of the spinning frame, along each of which one respective service device 6 or 7 travels for purposes of performing sliver piecing operations after yarn breaks, placement of a sliver when a spinning station is provided with fresh sliver, and possible cleaning work on the spinning means of the individual spinning stations. The rails 4 and 5 extend beyond the head end 2 of the spinning frame containing the supply and drive units for the spinning stations and terminate at respective travel reversing points 8 and 9 of the service devices 6 or 7, sometimes commonly referred to as piecing carriages. In accordance with the present invention, transfer locations 10 or 11 for the sliver are located in the area of the travel reversing points 8 and 9 of the piecing carriages 6 and 7 and the piecing carriages are equipped with devices 12 or 13 by means of which they can transport sliver to the spinning stations 3 and deposit it thereat.

The sliver 14 is filled in cans 15 which correspond to conventional cans in respect to their size and the degree of filling. The diameter of each of these cans approximately corresponds to the width of two adjoining spinning stations 3. The cans 15 filled with sliver 14 are conveyed from a drawing frame (not shown) to the transfer locations 10 or 11 by means of a can transport vehicle 16. The can transport vehicle 16 moves along an electrical induction-defined pathway 17 placed into the floor 18 of the spinning room (FIG. 2), as indicated by the two-headed arrow 19. Of course, it will be understood that the can transport vehicle 16 can be guided or otherwise controlled to travel to the individual spinning frames by any other means, for example radio-controlled. Manual transport of the cans is also conceivable.

In the instant exemplary embodiment of the invention, the can transport vehicle 16 conveys three cans on its can support locations 20*a*, 20*b* and 20*c*. Cans 15 filled with sliver 14 are shown in FIG. 1 resting at the locations 20*a* and 20*b*, while an empty can 15 is shown at the location 20*c*. Each of the sliver cans 15 resting at the support locations 20*a*, 20*b*, 20*c* are provided with clamps 21, in which the leading end 22 of the respective sliver is held at a defined length, as represented by the cans at locations 20*a* and 20*b*. The cans 15 are oriented on the vehicle with the clamps 21 of the cans aligned exactly perpendicularly in respect to the direction of travel 19, so that the starting end of sliver 22 can be easily grasped automatically by the manipulator after transfer of the cans. Can lifting and depositing devices 23 are provided at the individual can support locations 20*a* to 20*c*, by means of which each can may be lifted from the support locations and moved off the support locations. The can transport vehicle 16 is also equipped with positioning means 24 at each of the can support locations 20*a* to 20*c*, by means of which the transport vehicle can be positioned relative to can support locations 25 and 26 at the respective transfer locations 10 and 11. The can support locations 25 and 26 are each equipped with detectable positioning elements 27 so that the can transport vehicle can recognize the support locations 25 and 26. In addition, the positioning elements 27 enable other information to be communicated to the can transport vehicle 16, such as the respective degree of occupation of the can supporting locations 25 or 26. Manipulable sliver transfer devices H1 and H2 for removing the sliver 14 from the cans on the support locations 25 and 26 are disposed in front of the head end 2 of the open-end spinning frame 1.

A can 15 containing a sliver 14 is shown in FIG. 1 to be resting at the transfer location 10 in the can support location 25. A sliver gripping device 28 of the sliver transfer device H1 is shown entering into the can for removing the sliver. The gripper 28 is disposed at the outward end of a laterally extending arm 29 for raising and lowering movement relative to the arm 29. The arm 29 in turn is mounted on a shaft 30 for rotation of the arm as well as raising and lowering movements. A pivot arm 31 is also mounted on the shaft 30 so that it may also be rotated and raised and lowered and has a device 32 at its outer end for picking up the leading end 22 of sliver at the clamp 21 of the sliver can 15.

In order for the sliver 14 from the sliver can 15 to be transferred to one of the piecing carriages 6 and 7, it must first be removed from the can 15. However, as a rule, the entire contents of a can when completely filled is too voluminous to be transported by means of one piecing carrier. Hence, in accordance with the present invention, the sliver contents of a full can 15 is divided into two partial lots TM. The transfer of the sliver 14 from a can 15 to a service device, i.e., the piecing carriage 6 or 7, will be described by means of FIGS. 1 and 2.

The gripper 28 of the sliver transfer device H1 may be inserted downwardly into the sliver can 15 in the direction of the arrow 36u into the central axial opening 80 defined and surrounded by the annularly arranged sliver layers 35 (FIG. 4) formed in conventional manner in the original filling of sliver cans. The depth of insertion depends on the amount of sliver to be removed. The gripper 28 has several spreadable fingers 34 distributed over its lower head end 33. Their function will be explained in detail in the description of FIG. 4. It is possible to remove several sliver layers 35 from the can by means of the spreadable fingers 34. Before the sliver is removed from the can, the device 32 on the pivot arm 31 grasps the leading end 22 of sliver at the clamp 21 on the can 15 and removes the sliver end from the clamp.

Figure 2:
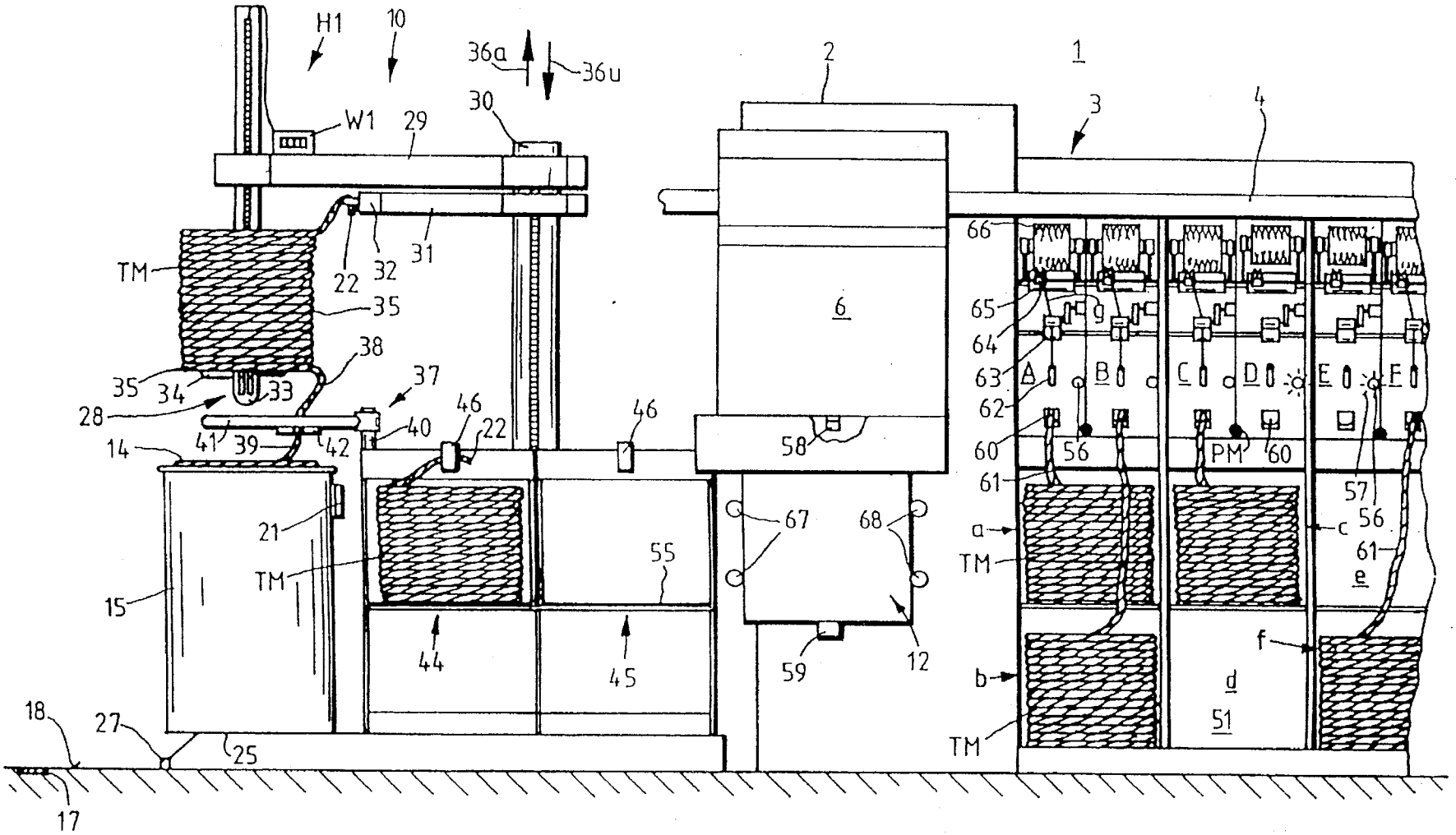
FIG. 2 is a lateral side elevational view of the head end of the spinning frame and the adjoining transfer point of FIG. 1.

For removing a partial sliver lot TM from the sliver can 15, the gripper 28 and the pivot arm 31 are moved upwardly in the direction of the arrow 36*a* in FIG. 2 far enough that the gripper head 33 is located above the device 37. By means of the device 37, the trailing extent 38 of the sliver extending between the partial lot TM lifted by the gripper 28 and the sliver remaining in the can 15 can be cut and the freshly created leading end 39 of sliver may be clamped. The clamping and separating device 37 consists of a lever 41, which can be pivoted about a shaft 40 in a horizontal plane and which is concavely curved in the direction toward the can 15 for moving the sliver to the clamping shears 42. The trailing sliver 38 extending from the partial lot TM to the sliver remaining in the can 15 is cut with the clamping shears and the sliver 39 emerging from the can is clamped. This clamped sliver is the fresh sliver end 22 of the second partial lot in the can.

Following the removal of the sliver lot TM, the arm 29 with the gripper 28 and the partial sliver lot TM held by it pivots in the direction of the arrow 43 (FIG. 1) into disposition above an empty storage location 44 or 45 at the transfer location 10 and deposits the sliver thereat. In the course of depositing the sliver lot at one of the storage locations, the sliver end 22, which is still held by the device 32 for lifting the sliver end, is introduced into a clamp 46 at the storage location so that it is ready in a defined position and at a defined length for subsequent pick-up by a manipulator on the piecing carriage. In FIG. 2, a partial sliver lot TM has been deposited on the storage location 44 and the sliver start 22 has been made ready in the clamp 46. The storage location 45 is already empty, because the sliver lot has been transferred to the device 12 on the piecing carriage 6 for the transport of the sliver. The partial lot TM picked up by the gripper 28 can therefore be deposited on the storage space 45.

It is possible to weigh each respective partial sliver lot TM upon removal by the gripping device 28 by means of a weighing device W1 on the gripper 28. For example, the weight of a partial lot TM can be detected by means of the load on the fingers 34. In turn, it is possible to calculate an amount of yarn to be spun from the weight of the partial lot. This is advantageous in case of a batch change, for example, when it is intended that only certain spinning stations are to be provided with matched partial sliver lots for creating complete bobbins.

FIG. 1 represents a state at the transfer location 10 which is previous in time in respect to the state illustrated in FIG. 2. In FIG. 1, the storage location 44 at the transfer location 10 has not yet been occupied by a partial sliver lot and the piecing carriage 6 is positioned in front of the storage location 45 for taking up the partial sliver lot TM deposited there. For transferring the partial lot TM, the storage location 45 has come into operational engagement with the device 12 for sliver transport on the piecing carriage 6. At the same time, the manipulator 47 (shown only schematically) for gripping the sliver end 22 has been extended to remove it from the sliver clamp 46 and, as shown, the manipulator 47 has already grasped the sliver end 22 by means of an aspirating nozzle 48. The manipulator can correspond to one of the exemplary embodiments known from German Patent Publication DE 42 04 044 A1.

In FIG. 1, the piecing carriage 7 has stored a partial sliver lot on its device 13 for sliver transport. The manipulator 49 is also illustrated. In the transport position, the manipulator 49 is retracted into the piecing carriage 7 and keeps the partial lot TM ready for introduction into one of the spinning stations 3 by means of its aspirating nozzle 50.

As already mentioned, the diameter of a can 15 is approximately the same as the lateral dimension of two adjoining spinning stations 3. For this reason, the partial sliver lot TM to be deposited at the spinning stations has a larger diameter than the width of a spinning station, so that with two adjoining spinning stations it is necessary to deposit their respective partial lots in stacked compartments placed above each other underneath the two spinning stations. The width of each compartment therefore is the width of two spinning stations and each one of the compartments is assigned to a corresponding one of the spinning stations located above them. This is represented in FIG. 2 and will be explained in further detail below. In FIG. 1, a partial sliver lot TM is shown in the process of being deposited onto a storage location 51 of one of the spinning stations by the piecing carriage 7 by means of the associated sliver transport device 13. Subsequently, the sliver end 22 is introduced by means of the manipulator 49 into the spinning station whose storage location 51 has been exhausted of sliver, and the normal piecing process is then performed.

When the piecing carriage 6 or 7 is positioned in front of a spinning station for repairing a yarn break, it is not centered in front of a sliver storage location 51 and hence the associated sliver transport device 12 or 13 disposed under the piecing carriage would not be able to deposit the sliver in one of the compartments. For depositing the partial sliver lot TM, the piecing carriage 6 or 7 is therefore first positioned in the center between the requesting spinning station and the adjacent spinning station, whose storage place is located above or below the empty storage place. For positioning, the piecing carriage can orient itself by means of the sensor 58 at position markers PM (FIG. 2) respectively located on the common wall between two adjoining spinning stations. Following the deposit of the sliver in the compartment 51 of the requesting spinning station, the piecing carriage is moved laterally and positioned in front of the spinning station in order to introduce and piece the sliver with the yarn.

A possible embodiment not shown in the drawings is contempated wherein the sliver transport device 12 or 13 of each piecing carriage 6 or 7 is disposed underneath the associated piecing carriage and is displaceable laterally with respect to it. When the piecing carriage has been positioned in front of the spinning station requiring a supply of sliver, the device 12 or 13 is positioned in front of the storage location assigned to the from the sliver can 15, and a clamping and separating unit 370 comprising a lever 410 with associated clamping shears 420, pivotable around a shaft 400, for forming a fresh sliver end, each of which are shown in their initial starting position.

Figure 3:
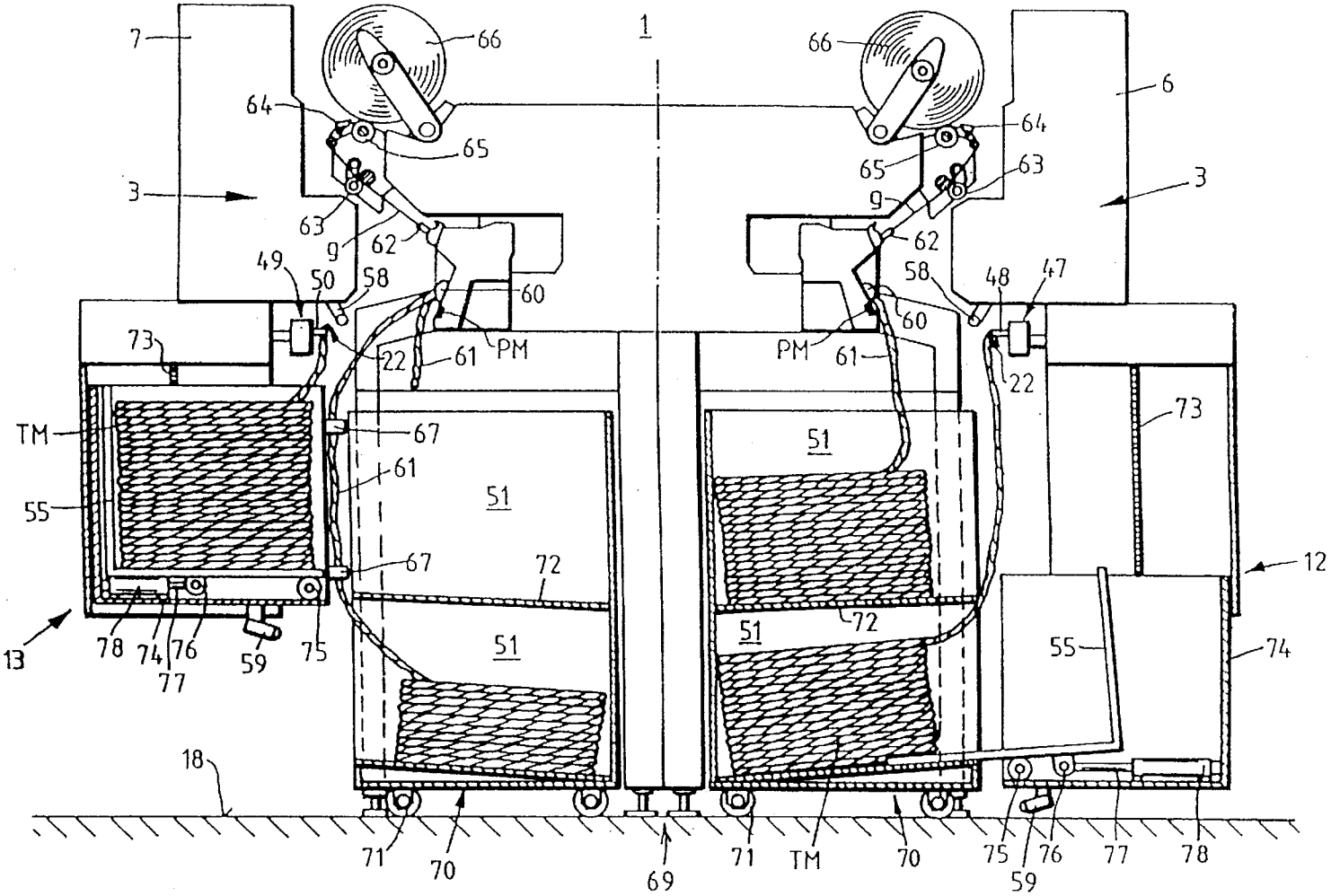
FIG. 3 is a vertical cross sectional view through the spinning frame of FIGS. 1 and 2 showing opposite spinning stations whereat piecing carriages according to the present invention have been positioned for transferring slivers.

To make handling of the partial sliver lots TM and the respective transfer from the storage locations 44 and 45 at the transfer location 10 and storage locations 52 and 53 at the transfer location 11 to storage locations at the spinning stations 3 by means of the devices 12 or 13 for sliver transport on the piecing carriage 6 or 7 easier, the storage locations 44, 45, 52 and 53 and the devices 12 and 13 are respectively equipped with L-shaped sheet metal elements 54 and 55 of the approximate width and height of a partial sliver lot TM. These sheet metal elements 54 at the storage locations 44, 45, 52 and 53 and the sheet metal elements 55 at the sliver transport devices 12 or 13 on the piecing carriage 6 or 7 are displaceable by piston and cylinder assemblies as illustrated in FIG. 3 and are easily pivotable. Such an L-shaped sheet metal element 55 for depositing and handling a partial sliver lot TM at a device for sliver transport on a piecing carriage can be seen in cross section in FIG. 3.

A lateral view of spinning stations 3 is represented in FIG. 2. Respectively adjoining pairs of spinning stations A and B, C and D, and E and F have stacked storage locations a and b, c and d, and e and f, respectively, for the sliver disposed below each other, the storage location a being assigned to the spinning station A, the storage location b being assigned to the spinning spinning station by being laterally displaced in respect to the piecing carriage.

In FIG. 1, another device H2 for removing sliver from sliver cans, corresponding to the device HI at the transfer location 10, is arranged at the transfer location 11 in mirror image to the device H1. The support location 26 for a sliver can associated with the device H2 is shown to be empty. The sliver can 15 depicted at the support location **20*c* on the transport vehicle 16 had previously been in use at the support location 26 and is shown s having already been transferred onto the support location 20*c* by the can transport vehicle 16 after having been emptied of its sliver by the device H2, the support location 20*c* of the vehicle 16 being positioned in front of the support location 26 for such purpose. Following this transfer, the can transport vehicle 16 will move ahead by one support location in order to unload the full can resting on the support location 20*b* onto the support location 26 of the transfer location 11. The transfer device H2 also inclues a gripper mechanism 280 substantially the same as the gripper 28, the gripper 280 being shown to have been pivoted around its shaft 300 in the direction of the arrow 430 by means of the arm 290 in the process of depositing a partial sliver lot TM onto the storage location 52 of the transfer location 11. The storage compartment 53 of the transfer location 11 is already occupied by a partial sliver lot TM and the sliver end 22 is positioned in the associated sliver clamp 46. The transfer device H2 also includes a device 320 located on a pivot arm 310 for grasping the sliver end station B, and so forth. The storage locations consist of compartments as can be seen in section in FIG. 3, each of which correspond in their width to the width of two adjoining spinning (i.e., the diameter of a sliver can) and correspond in height and depth dimension to these dimensions of a partial sliver lot TM, which is one-half the contents of a can in the illustrated embodiment. With other can shapes and partial lots, other dimensions are conceivable. While the storage locations a, b, c and f shown in FIG. 2 are filled with sliver, the storage locations d and e are empty. The sliver at such locations has been exhausted and the associated spinning stations D and E accordingly are stopped. By means of a signaling device 56 which indicates the lack of sliver by means of an illuminated red light and an associated electrical signaling circuit 57, the piecing carriage 6 is requested to fix a yarn break. When the piecing carriage 6 arrives at either of the spinning stations D or E, it determines by means of a sensor 58 for the upper row of the storage locations a, c and e, and a sensor 59 for the lower storage locations b, d and f, that sliver is lacking in the associated storage locations d or e. In accordance with its load of a partial sliver lot and its direction of movement, the piecing carriage 6 first supplies a partial lot of sliver TM to the storage location d,the sliver end being introduced into the so-called condenser 60 of the spinning station D with the aid of the manipulator 47. The conventional piecing operation is subsequently performed. If the piecing carriage 6 has two devices for transporting sliver, it can A lateral cross section through the open-end spinning frame showing two back-to-back spinning stations is represented in FIG. 3. A frame 70 having two sliver storage locations 51, arranged one atop the other, is arranged underneath an associated adjacent pair of spinning stations 3 in the space where the sliver cans are usually placed alongside the machine frame 69, as can be seen in FIG. 2. As shown in FIG. 1, as a rule a large number of adjoining sliver compartments 51, advantageously the storage locations of a whole section, are combined into a frame 70, which preferably is supported on rollers 71. As a result, it is possible to easily pull the frames 70 outward from underneath the associated spinning sections, for example for cleaning. The dividers 72 between the individual storage locations 51 can also be disposed to be adjustable in order to be able to vary the size of the respective partial sliver lots to be deposited in the compartments 51**.

The sliver transporting devices 12 and 13 which are suspended from the respective piecing carriages 6 and 7, are also shown in FIG. 3. In the exemplary embodiment shown, both devices are identical in their structures. However, for saving time, it can be advantageous to transport two partial sliver lots instead of one partial lot by means of one piecing carriage and for this purpose to arrange two devices for transporting slivers above each other on one piecing carriage. In such case, the equipment of the two devices would also agree with the equipment of the instant exemplary embodiment. A lifting and lowering device 73, which subsequently proceed to the spinning station E to supply its storage location e with sliver and also perform the sliver piecing operation thereat following the introduction of the sliver.

While the spinning stations D and E await their start-up, the adjoining spinning stations continue spinning without interruption. At the spinning stations A, B, C and F, sliver 61 is drawn from the respective compartment-like storage locations a, b, c and f into the condensers 60 of the respective spinning stations and is spun into yarn in accordance with the known open-end spinning method, and the yarn is respectively drawn off via a small draw-off tube 62 from the pair of draw-off rollers 63 and is wound on the cheese 66, driven by a lap roller 65 by means of a traversing thread guide 64.

Each of the the piecing carriages 6 and 7 has rods 67 and 68 (FIGS. 2 and 3), which can be extended at an appropriate height corresponding to the upper row of sliver storage locations a,c, and e during positioning of the carriage in front of a spinning station for loading an upper compartment to push the sliver pulled out of the lower compartment away from the outwardly facing opening of the upper storage location. In this manner, the sliver being drawn from the compartments of the lower row of storage locations (in this case for example from the storage location f) is not destroyed during the course of loading a new lot of sliver TM into an associated empty compartment of the upper row (for example at the storage location e). allows the loading of compartments 51 placed on top of each other with the same device 12 or 13, would not be required. This lifting and lowering device could be realized by means of a cable or chain hoist, for example, which can raise and lower the forwardly opening container 74. The L-shaped sheet metal element 54 is respectively disposed inside the containers 74. A partial sliver lot TM is respectively deposited on this L-shaped sheet metal element 54 at the transfer locations 10 and 11.

In FIG. 3, a partial sliver lot TM is being transferred to a storage location 51 in the frame 70 by the sliver transport device 12 on the piecing carriage 6. Since this storage location 51 lies in the lower row of compartments, the container 74, on which the partial sliver lot TM had rested within the L-shaped sheet metal piece 54, was lowered to the level of the lower storage location 51 by means of the lifting and lowering device 73. The L-shaped sheet metal element 54 rests on rollers 75 at the front of the container 74, which are respectively disposed on the lateral wall of the container. The piston 77 of a hydraulic or pneumatic cylinder 78 engages the bottom of the sheet metal element 54 at the fastening point 76 and is offset toward the center, viewed in the linear direction. When the piston 77 is extended, the bottom of the L-shaped sheet metal element 54 moves over the rollers 75 and, because of the weight of the partial sliver lot TM, tilts over the rollers 75. This eases the transfer of the sliver to the storage locations 51. The device 12 is depicted as having transferred the sliver and the L-shaped sheet metal element 54 is being retracted from the storage location 51. The sliver end 22 is held by the suction nozzle 48 of the manipulator 47. Following the successful transfer of the partial sliver lot TM, the manipulator is moved outward for introducing the sliver end 22 into the condenser 60 of the spinning station to which the just loaded compartment 51 is assigned.

The piecing carriage 7 with its sliver transporting device 13 has also been positioned in front of an empty storage location 51 underneath a spinning station 3. Since this is an empty storage location 51 in the upper row of the compartments, the rods 67 have been extended to push aside the sliver 61 drawn from the lower compartment into the adjoining spinning station such that the upper compartment can be loaded without interfering with the other spinning stations. The sensor 58 on the piecing carriage 7 has sensed that the upper compartment was empty. The container 74 does not need to be lowered when loading a storage space 51 in an upper row of the frame 70. The L-shaped sheet metal element 54 with the partial sliver lot TM is now extended in the direction toward the storage space 51 which is to be loaded. In this case also, the manipulator 49 keeps the end of the sliver 22 ready by means of a suction nozzle 50 for introducing it into the condenser 60 of the spinning station in which a yarn break occurred because of a lack of sliver.

After loading the empty storage locations 51 and introducing the sliver into the respective condensers, the spinning station is started and the sliver is drawn into the spinning station, following which a piecing operation is performed. Subsequent to successful piecing-up of the sliver, the piecing carriages 6 and 7 will proceed to patrol along the spinning stations to repair yarn breaks which are not caused by a lack of sliver. When the carriages 6 and 7 arrive at the respective reversing points 8 and 9 at the transfer locations 10 or 11, they will transfer a ready sliver lot TM from a compartment 44 or 45 thereat to their respective sliver transport devices 12 and 13 and resume patrolling travel along the machine during which empty storage locations 51 are loaded with the partial sliver lots TM in the manner described above.

Figure 4:
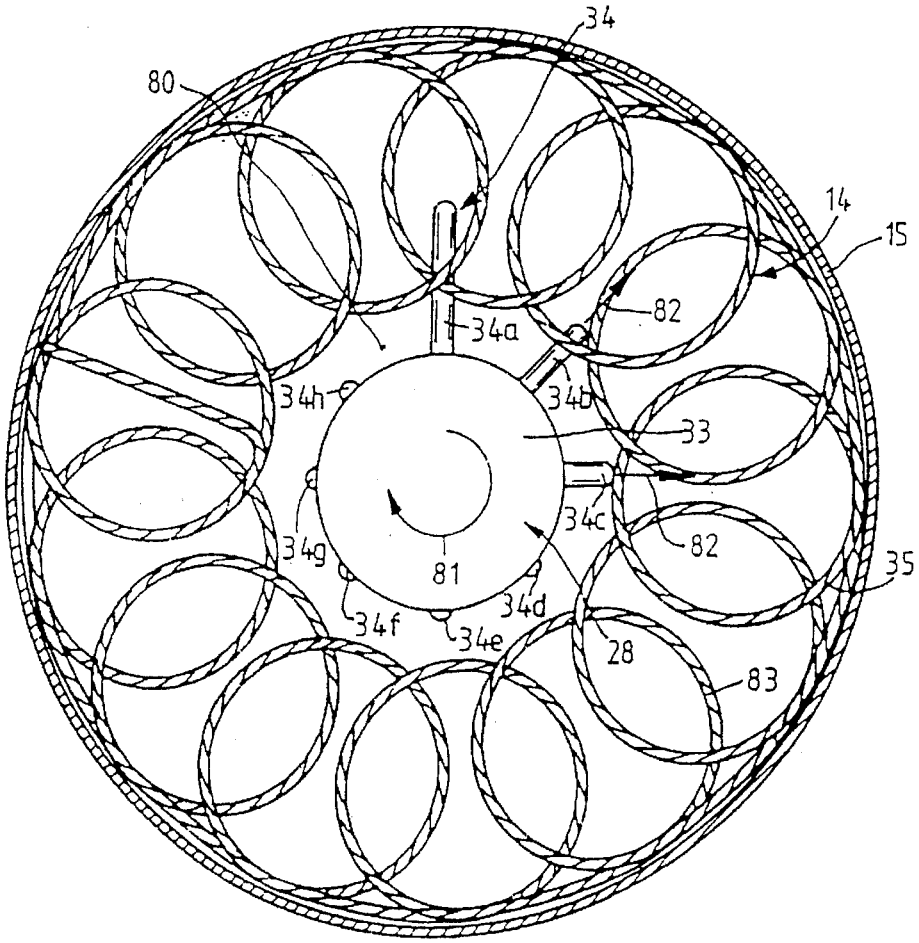
FIG. 4 is a top plan view of the gripper of the sliver transfer arrangement of FIGS. 1 and 2 for removing sliver from delivered sliver cans, shown dipping into a can filled with sliver.
Figure 5:
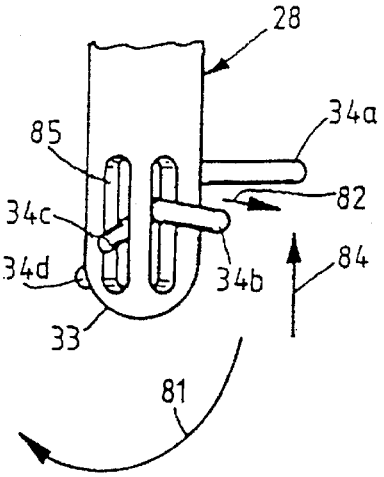
FIG. 5 shows the head of the gripper of FIG. 4 with extendible fingers.

FIGS. 4 and 5 show in greater detail the gripper head 33 of the gripper device 28. The structure of the gripper 280 also corresponds to this exemplary embodiment. To be able to lift a partial sliver lot TM out of a completely filled can, the gripper 28 is manipulated by means of its supporting arm assembly to descend into the central opening 80 enclosed by the conventional annular arrangement of sliver coils 35 normally formed in filling sliver cans. This opening 80 in the center area of the can remains free of sliver when the sliver 14 is deposited in layers 35 in a can 15. To remove a defined partial lot TM from the can 15, the gripper head 33 of the gripper 28 descends to a defined depth into the opening 80. The gripper head 33 has finger 34 distributed over its circumference. During the descent into the opening 80, the fingers 34 are retracted into the gripper head 33. Once the gripper head 33 has reached its preselected position, one finger 34 after the other is extended outward, for example clockwise as indicated by the arrow 81 in FIG. 5. The gripper head can have six to twelve fingers which are extended successively outward from the center of the gripper head. Eight fingers are shown for example in FIG. 4, with the finger **34*a* already completely extended, the fingers 34*b* and 34*c* still being extended as indicated by the arrow 82, and the fingers 34*d* to 34*h* not yet extended. The fingers 34*a* to h are extended sequentially in the direction of rotation 81 in which the circular sliver coils 83 were originally deposited in the can 15. Following their complete extension, the fingers are lifted by a few centimeters, as represented by the arrow 84 in FIG. 5 during which the fingers 34 move upwardly in respective slits 85 in the gripper head 33. When the first finger 34*a* has been inserted underneath a layer 35 of the sliver and lifts it, the next finger enters the gap generated by the preceding finger. Following the extension of all fingers 34*a* to 34*h*, a layer 35 of the sliver has been lifted off the layer underneath it and the gripper 28 can remove a partial sliver lot TM upwardly from the can. FIG. 5 shows in a perspective view the state of the gripper head 33 represented in FIG. 4** and the degree to which the fingers have already been extended and lifted.

In the exemplary embodiment of FIGS. 1–3, each partial sliver lot TM taken out of a respective can is first deposited on a storage location 44 or 45 at the transfer locations 10 or 11. However, a direct transfer to the devices for transporting and transferring of sliver on the piecing carriages is also conceivable.

Likewise, devices other than the gripper device 28 for removing the sliver are also conceivable. For example, it is possible to push against the bottom of the sliver can from below the can, so that the sliver is pushed out of the can. A guide placed on the can keeps the pushed out sliver layers from dropping. Once the desired amount of sliver has been pushed out, a slide element may separate the layers above the rim of the can from those remaining within the can and the sliver may then be simultaneously cut by appropriate devices from the partial lot remaining in the can.

It is also conceivable to upend the can and to deposit a predetermined amount of sliver on appropriate storage locations by pulling the can upward to release a portion of the sliver, a partial lot being created by pushing a sheet metal element across the downwardly facing rim of the can to separate the sliver layers from each other.

Figure 6:
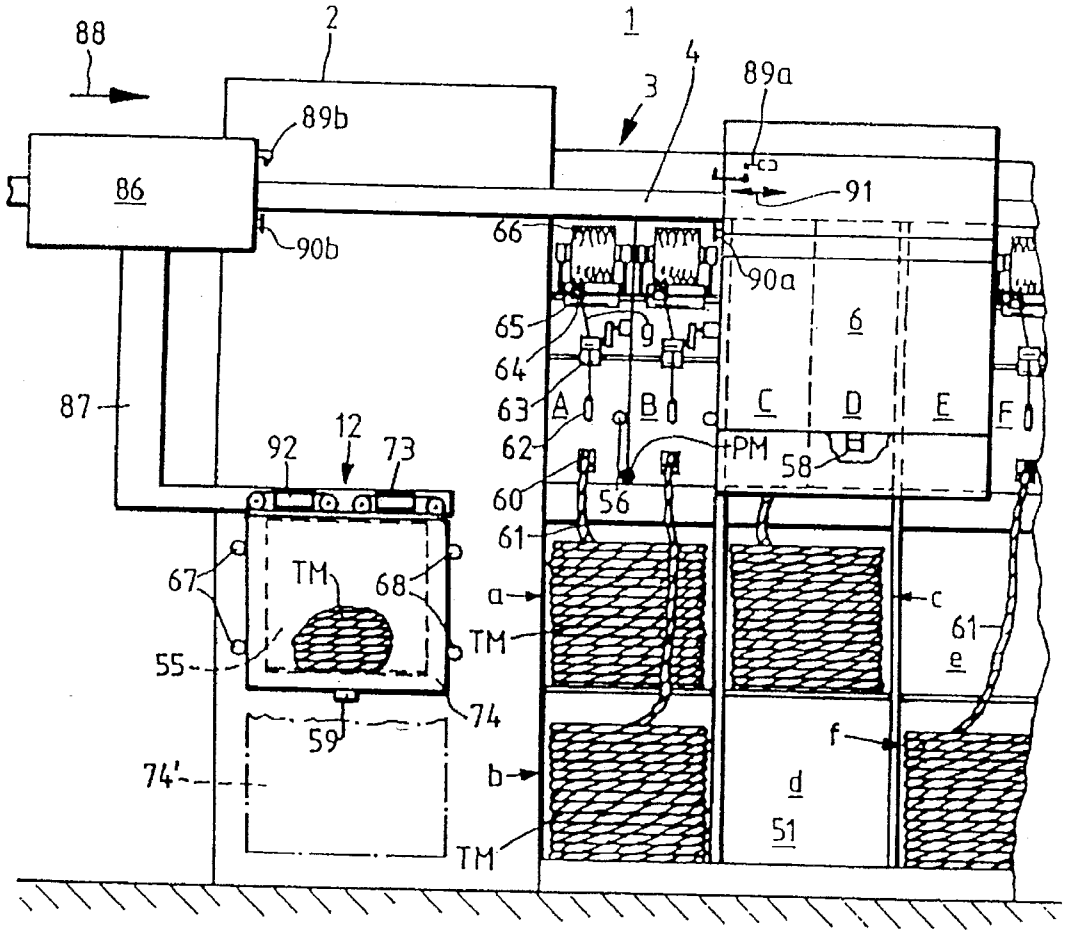
FIG. 6 is a side elevational view representatively depicting an exemplary embodiment of the present invention wherein the service device is connected with the piecing carriage.

Another exemplary embodiment is represented in FIG. 6, wherein the device 12 for transporting and depositing sliver lots TM is releasable coupled with the piecing carriage 6. The sliver transporting device 12 has its own drive element 86 which is movably supported on the rail 4 by an angularly bent support arm 87 such that the device 12 is positioned underneath the piecing carriage when the drive element 86 is coupled to the piecing carriage 6.

In the embodiment of FIG. 6, the piecing carriage 6 is depicted as decoupled from the sliver transporting device 12 and positioned in front of the spinning station D for repairing a yarn break. However, the sliver at this spinning station D is also shown as having been exhausted, as can be seen from the empty storage location d. The piecing carriage 6 therefore cannot repair the yarn break and will continue traveling until it comes to a spinning station where a yarn break resulting from a yarn defect has occurred.

The sliver transporting device 12 is shown in FIG. 6 as traveling from the sliver transfer location (not shown) in the direction of the arrow 88 toward the piecing carriage 6 to be coupled therewith, having received a partial sliver lot TM at the transfer location. Coupling takes place by means of a coupling device which is indicated by an actuable coupling 89*a* on the piecing carriage 6 and a towing hook 89*b* on the drive element 86. When the device 12 has been coupled to the piecing carriage 6, control of the device 12 is actuated from the piecing carriage. As indicated, the electrical signalling lines are coupled for this purpose by means of engagement between an appropriate connector 90*a* on the piecing carriage and a mating connector 90*b* on the drive element 86.

To position the sliver transporting device 12 when transferring the sliver to a storage location, the device can be positioned by means of the extendible and retractable coupling device as indicated by the two-headed arrow 91. However, displacement of the container 74 on the support arm 87 by means of a chain traveling mechanism such as a chain drive 92 is also conceivable. FIG. 6 also indicates the lifting and lowering device 73 which makes loading of the storage locations 51 in the lower row of the compartments possible. In particular, the container 74 is indicated in broken lines in the lowered position 74'.

Instead of moving the device 12 over the rail 4 by means of a drive element 86, it is also possible to provide a floor conveying vehicle, which is guided along the spinning stations, for example via electrical induction control means disposed on or in the floor.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for supplying sliver taken from sliver containing cans produced at a sliver drawing frame to a plurality of aligned spinning stations of an open-end spinning frame which are serviced by a servicing device which travels in a path along the spinning stations to perform servicing operations thereat, the method comprising the steps of:

transporting a sliver containing can to a transfer location at the open-end spinning frame located along the travel path of the servicing device, removing a partial lot of the sliver from the can at the transfer location, transferring the partial sliver lot to the servicing device, during subsequent servicing travel of the servicing device along its travel path, transferring the partial lot of sliver from the servicing device to a storage location at a spinning station whereat sliver is lacking and introducing the leading end of the partial lot of sliver by means of the servicing device into the spinning station, and then causing the servicing device to resume servicing travel along the spinning stations following the successful introduction of the sliver to the spinning station.

2. A method in accordance with claim 1, and further comprising the step of piecing the leading end of the partial lot of sliver by means of the servicing device following the introducing of the sliver to the one spinning station.

3. A method in accordance with claim 1, wherein the travel path of the servicing device includes a reversing point at one end of the spinning frame at which the servicing device reverses its direction of traveling movement and wherein the step of transferring the sliver to the servicing device is performed at a reversing point of the servicing device.

4. A method in accordance with claim 1, and further comprising the step of depositing the partial lot of sliver removed from the sliver can onto at least one storage location at the transfer location prior to transferring the sliver lot to the servicing device.

5. An open-end spinning frame comprising:

a plurality of spinning stations for spinning sliver into yarn, a servicing device movably disposed to travel in a path along the spinning stations for performing servicing operations at the spinning stations, means on the servicing device for receiving and transporting a quantity of sliver, at least one sliver transfer location located along the travel path of the servicing device, a sliver transfer device for removing a partial lot of sliver from a sliver containing can at the transfer location and transferring the partial sliver lot to the sliver receiving and transporting means on the servicing device, a storage location at each spinning station for containing sliver being supplied to the spinning station during spinning of yarn, and means on the servicing device for transferring a partial lot of sliver from the sliver receiving and transporting means to the spinning station storage location of each spinning station.

6. An open-end spinning frame in accordance with claim 5, wherein the servicing device includes a manipulator for introducing an end of a partial lot of sliver from a spinning station storage location into the associated spinning station in order to initiate the piecing process.

7. An open-end spinning frame in accordance with claim 6, wherein at least one sliver storage location is provided at the transfer location for supporting a partial lot of sliver after removal from a sliver containing can and includes means for retaining an end of a supported sliver lot at a defined location for transfer to the manipulator.

8. An open-end spinning frame in accordance with claim 7, wherein the sliver transfer device includes means for grasping and cutting the sliver between two partial lots and for positioning the sliver end of the second partial lot at a defined location at the sliver containing can for subsequent transfer by the sliver transfer device to the retaining means of the sliver storage location at the transfer location.

9. An open-end spinning frame in accordance with claim 6, wherein the sliver receiving and transporting means and the servicing device are releasably coupled with one another and the sliver receiving and transporting means includes a respective drive for autonomous movement to and from the transfer location for receiving sliver lots.

10. An open-end spinning frame in accordance with claim 5, wherein at least one sliver transfer location is located at a reversing point along the travel path of the servicing device.

11. An open-end spinning frame in accordance with claim 5, wherein the sliver transfer device for removing sliver from the sliver containing can at the transfer location includes sliver gripping means for gripping and removing a partial lot of sliver from a sliver containing can.

12. An open-end spinning frame in accordance with claim 11, wherein the sliver containing can contains sliver in an annular layering of sliver coils defining a central axially extending open area within the can, and wherein the gripping means includes a gripper head for insertion into the open area in the can, fingers distributed annularly about the gripper head, means for sequentially extending the fingers in the annular direction in which the sliver coils were deposited into the can, and means for moving the gripper head axially relative to the open area within the can for inserting the gripper head into the open area and for removing a partial lot of sliver from the can.

13. An open-end spinning frame in accordance with claim 11, wherein the gripping means includes a weighing device for determining the weight of a partial sliver lot removed from a can.

14. An open-end spinning frame in accordance with claim 5, wherein each sliver storage location at the spinning stations comprises an open compartment for inserting therein a partial sliver lot.

15. An open-end spinning frame in accordance with claim 14, wherein the sliver compartments for the spinning stations of a section of the spinning frame are structurally combined as a unit.

16. A open-end spinning frame in accordance with claim 5, further comprising means for detecting the absence of a supply of sliver at the storage locations of the spinning stations.

17. A method for supplying sliver taken from sliver containing cans produced at a sliver drawing frame to a plurality of aligned spinning stations of a spinning frame which are serviced by a servicing device which travels in a path along the spinning stations to perform servicing operations thereat, the method comprising the steps of:

transporting a sliver containing can to a transfer location at the open-end spinning frame located along the travel path of the servicing device, removing sliver from the can at the transfer location, transferring the sliver removed from the can to the servicing device, during subsequent servicing travel of the servicing device along its travel path, transferring sliver from the servicing device to a storage location at spinning station whereat sliver is lacking and introducing the leading end of the transferred sliver by means of the servicing device into the spinning station, and then causing the servicing device to resume servicing travel along the spinning stations following the successful introduction of the sliver to the spinning station.

* * * * *